US008356366B2

(12) United States Patent
Fiegener et al.

(10) Patent No.: US 8,356,366 B2
(45) Date of Patent: Jan. 22, 2013

(54) GLOVE HAVING A FLEXIBLE CUFF WITH INTEGRAL VENT

(75) Inventors: John D. Fiegener, Marblehead, MA (US); Daniel R. Armstrong, Newport, KY (US); Michael Tinstman, Malden, MA (US)

(73) Assignee: adidas AG, Herzogenaurach (DE)

( * ) Notice: Subject to any disclaimer, the term of this patent is extended or adjusted under 35 U.S.C. 154(b) by 218 days.

(21) Appl. No.: 12/770,925

(22) Filed: Apr. 30, 2010

(65) Prior Publication Data

US 2010/0281599 A1 Nov. 11, 2010

Related U.S. Application Data

(60) Provisional application No. 61/175,829, filed on May 6, 2009.

(51) Int. Cl.

| | |
|---|---|
| ***A41D 27/02*** | (2006.01) |
| ***A41D 27/28*** | (2006.01) |
| ***A63B 71/14*** | (2006.01) |
| *A41D 19/00* | (2006.01) |

(52) U.S. Cl. ..... 2/159; 2/16; 2/161.1

(58) Field of Classification Search ..... 2/455, 16–21, 2/159, 160, 161.1, 161.6, 161.7, 162, 164, 2/167, 170, DIG. 1

See application file for complete search history.

(56) References Cited

U.S. PATENT DOCUMENTS

| | | | | |
|---|---|---|---|---|
| 3,605,117 | A * | 9/1971 | Latina | 2/16 |
| 4,484,359 | A | 11/1984 | Tirinen | |
| 4,815,147 | A | 3/1989 | Gazzano et al. | |
| 4,947,868 | A * | 8/1990 | Schoolman | 128/847 |
| 4,965,886 | A * | 10/1990 | Ockels | 2/2.16 |
| 5,088,115 | A * | 2/1992 | Napolitano | 2/69 |
| 5,511,243 | A | 4/1996 | Hall et al. | |
| 5,517,694 | A * | 5/1996 | Fabry | 2/161.1 |
| 5,787,506 | A * | 8/1998 | Wilder et al. | 2/161.1 |
| 5,946,720 | A | 9/1999 | Sauriol | |
| 6,085,354 | A * | 7/2000 | Wilder et al. | 2/161.1 |
| 6,122,769 | A * | 9/2000 | Wilder et al. | 2/16 |
| D446,888 | S | 8/2001 | Morrow | |
| 6,543,057 | B2 * | 4/2003 | Beland et al. | 2/161.1 |
| 6,550,069 | B1 * | 4/2003 | Morrow | 2/161.1 |
| 6,813,780 | B2 * | 11/2004 | Morrow | 2/161.1 |
| 6,990,690 | B2 | 1/2006 | Gait | |
| 7,017,191 | B2 * | 3/2006 | Golde | 2/93 |
| 7,117,540 | B2 * | 10/2006 | Morrow | 2/161.1 |
| 7,318,241 | B2 * | 1/2008 | Morrow | 2/161.1 |
| 7,380,287 | B2 * | 6/2008 | DeSantis | 2/123 |
| 2003/0140404 | A1 * | 7/2003 | Golde | 2/465 |
| 2007/0245451 | A1 * | 10/2007 | Desjardins et al. | 2/159 |
| 2008/0083048 | A1 * | 4/2008 | Morrow et al. | 2/16 |
| 2008/0141435 | A1 * | 6/2008 | Friedman | 2/167 |
| 2008/0229475 | A1 * | 9/2008 | DeSantis | 2/123 |
| 2010/0058513 | A1 * | 3/2010 | Drosihn et al. | 2/162 |
| 2010/0313332 | A1 * | 12/2010 | Denis | 2/162 |

* cited by examiner

*Primary Examiner* — Bobby Muromoto, Jr.
(74) *Attorney, Agent, or Firm* — Sterne, Kessler, Goldstein & Fox P.L.L.C.

(57) ABSTRACT

A glove including a hand portion having a palm portion and an opposing back side portion, the back side portion including a plurality of protective portions formed therein, the palm portion and opposing back side portion defining a cavity, a cuff portion, a band disposed on and outward of the cuff portion and having a first ventilation opening, the cuff portion having a second ventilation opening disposed coaxially with the first ventilation opening, and wherein air traverses through the first and second ventilation openings to the cavity.

29 Claims, 4 Drawing Sheets

GLOVE HAVING A FLEXIBLE CUFF WITH INTEGRAL VENT

CROSS REFERENCE TO RELATED APPLICATIONS

This application claims priority from U.S. Provisional Application Ser. No. 61/175,829 filed May 6, 2009; the disclosure of which is incorporated herein by reference.

BACKGROUND OF THE INVENTION

1. Technical Field

The invention relates generally to an athletic glove for protecting a player's hand and wrist. More particularly, the invention relates to an athletic glove that allows full mobility of the hand during play and ventilation within the glove. Specifically, the invention relates to a vented athletic glove with a flexible cuff having an integral vent to provide air flow.

2. Background Information

Athletic gloves are well known and used in a variety of sports. In contact sports such as lacrosse and hockey, the glove must provide several functions. First, the glove must be padded throughout in order to prevent the player from being injured. Since sticks are used to control the ball or puck, there is a possibility that a player may be hit on the hands or wrists. To reduce the risk of injury, the gloves are heavily padded on the back of the hand and wrist areas.

The glove must also allow complete movement of the wrist and hand. Hand movement is a key component in the usefulness of the glove since the player must be able to grasp a stick and the ball or puck as necessary. To accomplish this, the padded back side of the glove may be partitioned to allow flexibility, while the palm side is generally a thinner fabric so that the player can grip the stick.

The glove must also provide proper ventilation for the player so that he or she does not sweat. In an attempt to provide ventilation, gloves include mesh areas on the back side of the glove to allow warm air to escape. The mesh areas may be located throughout the glove and are usually between padded areas. While mesh vents provide adequate ventilation, they also have several problems. Since the mesh area has to be close to the hand and cannot be covered, there is no padding at the vent. Without padding, the player could be injured by a stick or ball hitting the mesh vent and the player's hand through the mesh vent. Further, the player's hand is vulnerable to moisture entering the mesh vent. Since the vent is uncovered, moisture can enter the mesh vent and cause discomfort for the player.

Thus, there is a long felt need for an athletic glove which provides appropriate protection from injury while still allowing adequate ventilation flow.

SUMMARY OF THE INVENTION

The present invention broadly comprises a glove including a hand portion having a palm portion and an opposing back side portion, the back side portion including a plurality of protective portions formed therein, the palm portion and opposing back side portion defining a cavity, a cuff portion, a band disposed on and outward of the cuff portion and having a first ventilation opening, said cuff portion having a second ventilation opening disposed coaxially with the first ventilation opening, and wherein air traverses through the first and second ventilation openings to the cavity.

The present invention also broadly comprises a method ventilating a glove comprising the steps of directing an ambient air through an air flow gap into a first chamber, directing the ambient air through the first chamber and into the second chamber, directing the ambient air through the second chamber and into the hand chamber, and directing the ambient air across a player hand and through a cuff opening.

BRIEF DESCRIPTION OF THE DRAWINGS

The preferred embodiment of the invention, illustrative of the best mode in which Applicant has contemplated applying the principles of the invention, are set forth in the following description and are shown in the drawings.

FIG. 3 is a cross-sectional view of a preferred embodiment athletic glove with a flexible cuff having an integral vent taken generally about line 3-3 in FIG. 1 and arrows indicating air flow there through; and, FIG. 4 is an enlarged view of a portion of a preferred embodiment athletic glove with a flexible cuff having an integral vent and arrows indicating air flow there through.

DESCRIPTION OF THE PREFERRED EMBODIMENTS

Figure 1:
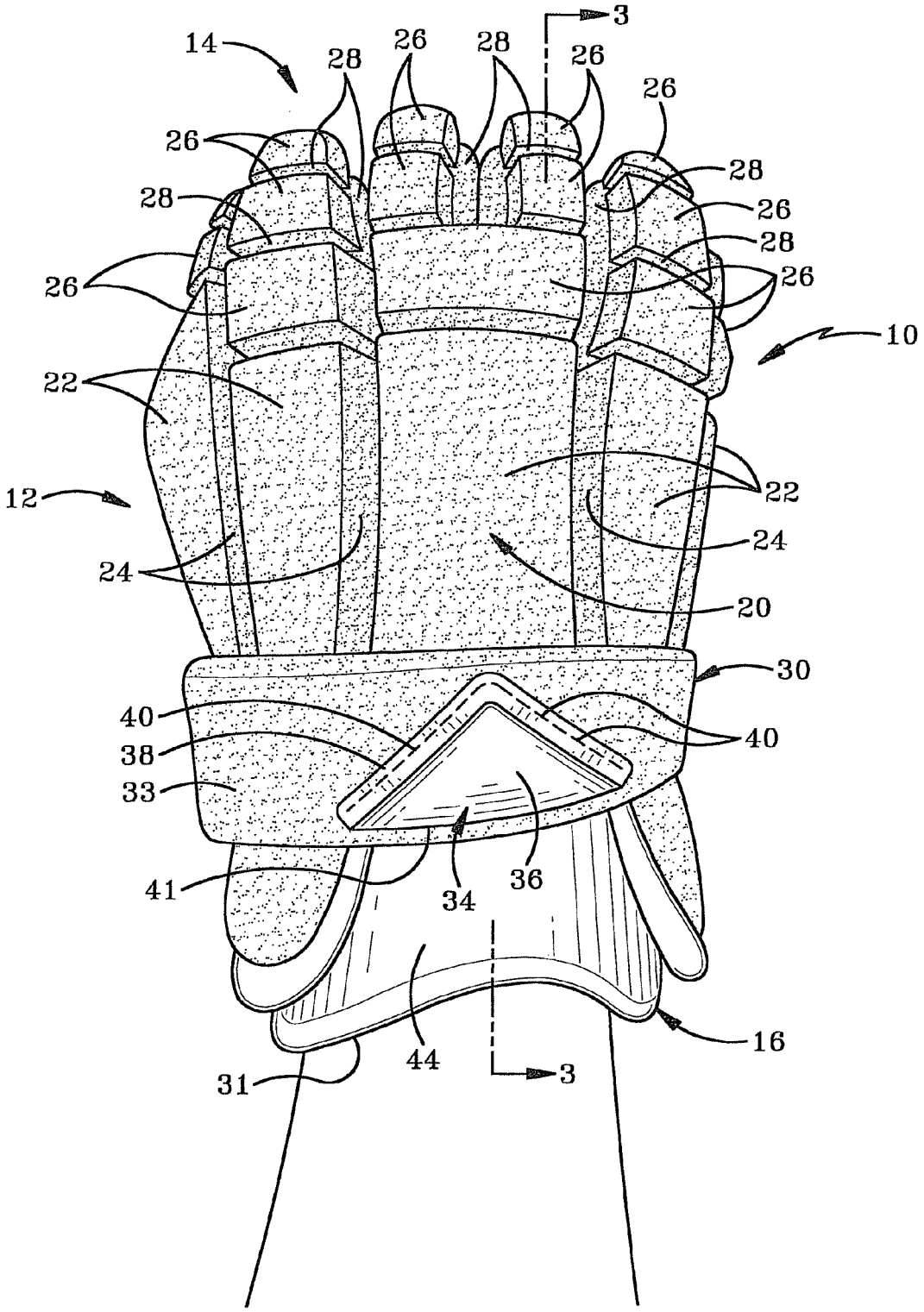
FIG. 1 is a front view of a preferred embodiment athletic glove with a flexible cuff having a band and an integral vent.

At the outset, it should be appreciated that like drawing numbers on different drawing views identify identical, or functionally similar, structural elements of the invention. While the present invention is described with respect to what is presently considered to be the preferred embodiments, it is to be understood that the invention as claimed is not limited to the disclosed aspects.

Unless defined otherwise, all technical and scientific terms used herein have the same meaning as commonly understood to one of ordinary skill in the art to which this invention belongs. Although any methods, devices or materials similar or equivalent to those described herein can be used in the practice or testing of the invention, the preferred methods, devices, and materials are now described.

The athletic glove of the present invention is indicated generally at 10, as is shown in FIGS. 1 through 4. As particularly shown in FIG. 1, a preferred embodiment glove 10 includes a hand portion 12, a finger portion 14, and a cuff portion 16. Hand portion 12 includes a palm portion 18 (FIG. 3) and an opposing back side portion 20. A plurality of protective portions 22 are formed in opposing back side portion 20 and separated by a plurality of valleys 24. Finger portion 14 also includes a plurality of protective portions 26 separated by a plurality of valleys 28. Cuff portion 16 includes an outer protective band 30 outward of cuff portion 16 and particularly located adjacent opposing back side portion 20.

Plurality of protective portions 22 are formed in opposing back side portion 20 and are preferably composed of a dense foam or other suitable substance which resists compression to protect the player from impact. Plurality of protective portions 26 are formed in finger portion 14 and are also preferably composed of a dense foam or other suitable material. Protective portions 22 are used to protect the back side of the player's hand, while protective portions 26 are used to protect the back side of the player's fingers. Valleys 24 between each protective portion 22 allow the glove to flex and enable the player to move his hand with reduced resistance. Similarly, valleys 28 between each protective portion 26 allow the player's fingers to move and bend individually.

In accordance with one of the main features of the invention, cuff portion 16 defines an opening 31 which extends inward into a hand chamber 35 defined by palm portion 18 and opposing back side portion 20 for the player to locate his hand 37 during use. Band 30 includes a first ventilation opening 32 (FIG. 3) formed in an outer layer 33 which is in turn protected by a cover 34. Cover 34 includes an upper portion 36 and a mounting flange 38. Cover 34 is secured to band 30 at mounting flange 38. In particular, the mounting flange is sewn to the band with thread 40, although any suitable method of attachment is within the spirit and scope of the invention as claimed.

In a preferred embodiment, cover 34 is generally triangular in shape and mounting flange 38 is disposed on two of the three sides. In this embodiment, mounting flange 38 is sewn to the band on two sides and leaves the third side unattached. Since upper portion 36 is generally domed shaped, an air flow gap 41 is formed between upper portion 36 and outer layer 33 of band 30. Although the preferred embodiment cover is shown and described as generally triangular in shape and a single opening, any suitable size, shape, or arrangement may be incorporated and is within the spirit and scope of the invention as claimed.

Figure 2:
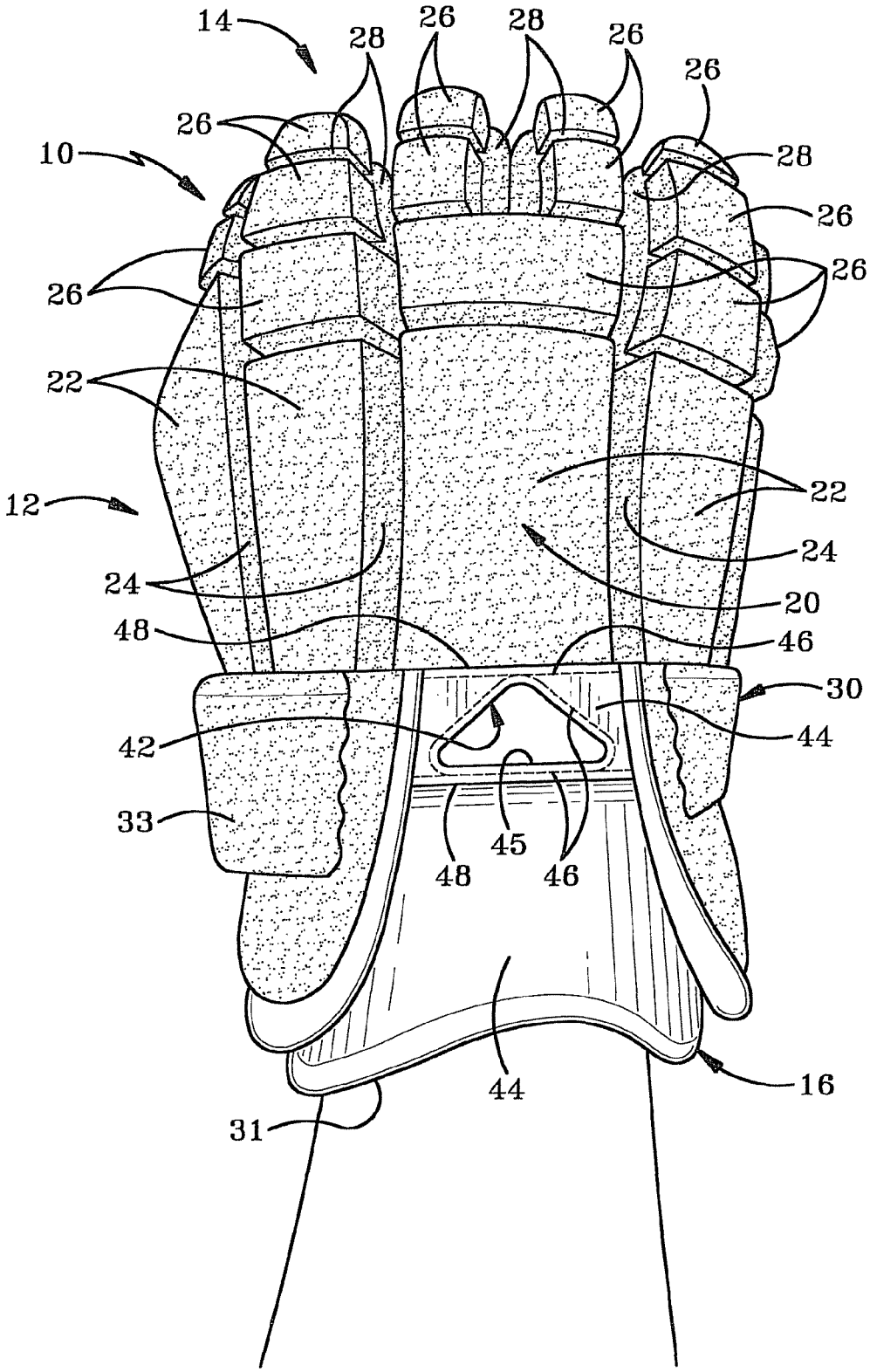
FIG. 2 is a front view of a preferred embodiment athletic glove with a portion of the band removed to show an opening within the glove to provide air flow.
Figure 3:
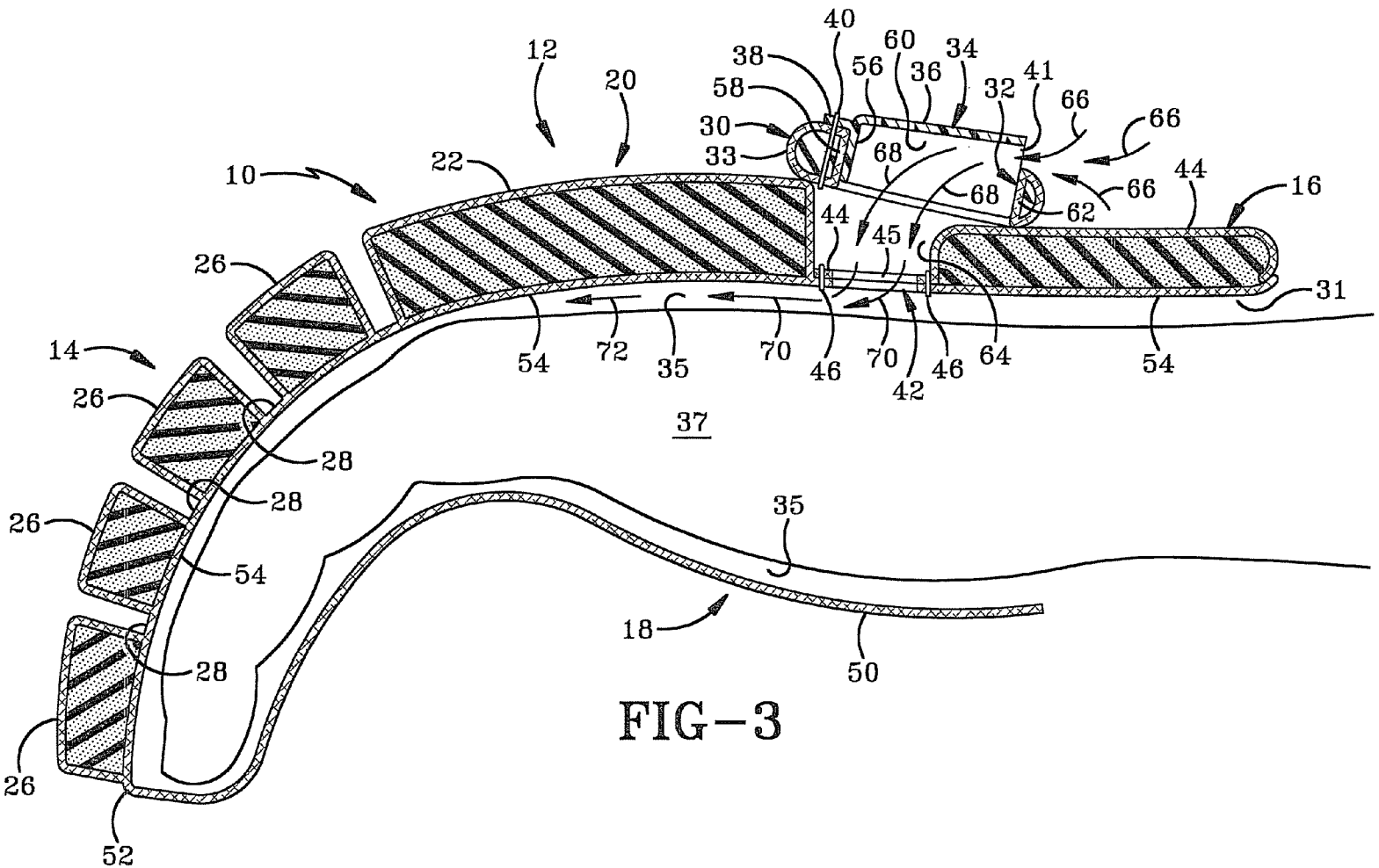

Moving on to FIG. 2, glove 10 is illustrated with a portion of band 30 removed and cuff portion 16 further exposed. In accordance with another main feature of the invention, cuff portion 16 includes a second ventilation opening 42. Outward of second ventilation opening 42 is a top layer 44 which is complimentary shaped to both the first and second ventilation openings and includes an intermediate opening 45 (FIG. 3). Top layer 44 is secured to cuff portion 16 with thread 46 immediately around second ventilation opening 42 and also proximate a periphery 48 the second ventilation opening. Advantageously, top layer 44 is helpful to provide structural integrity to second ventilation opening 42 which is generally thin.

Second ventilation opening 42 and top layer 44 are arranged concentric to one another and below first ventilation opening 32 such that all three openings are in communication with each other.

FIG. 3 illustrates a cross-sectional view of a preferred embodiment glove 10 in greater detail. Palm portion 18 includes a palm layer 50 which is formed with a thinner layer of material and connects to finger portion 14 at an end 52. While the preferred embodiment palm layer, finger portion, hand portion, and cuff portion are all composed of a generally continuous base layer 54, it should be readily apparent to one having ordinary skill in the art that any combination of base layers may be connected to provide firm or flexible areas within the glove.

Figure 4:
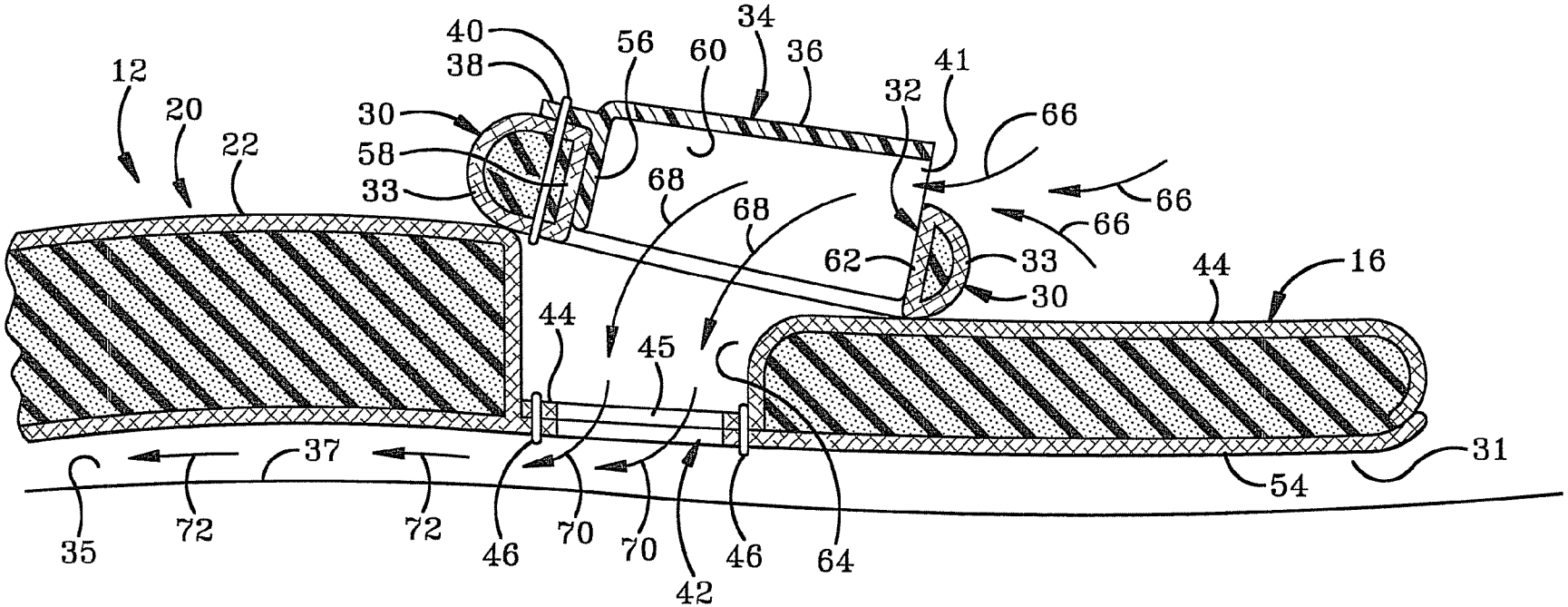

FIGS. 3 and 4 also provide cross-sectional and enlarged cross-sectional views of a preferred embodiment band 30 with first ventilation opening 32 and cuff portion 16 with second ventilation opening 42. Cover 34 also includes a stabilizing wall 56 extending downward from mounting flange 38 into first ventilation opening 32. Advantageously, stabilizing wall 56 allows placement of mounting flange 38 on less than the entire periphery of cover 34. In particular, stabilizing wall 56 increases rigidity of upper portion 36 by acting as a rotational stop against an inner wall 58 of band 30. Thus, when stabilizing wall 56 is utilized, the stabilizing wall defines at least a portion of the outer boundary of first ventilation opening 32.

Cover 34 also protects the user from injury since the cover prevents the entry of larger foreign objects. Similarly, upper portion 36 of cover 34 prevents entry of water, while still allowing adequate air flow. Since cover 34 is secured to band 30 at mounting flange 38, the only remaining opening is air flow gap 41. Air flow gap 41 is preferably small and only accessible from a horizontal orientation. The horizontal orientation is advantageous because air can still flow through the first and second ventilation openings and air flow gap 41, but the potential for water entering the glove is greatly reduced.

Further, band 30 includes a first chamber 60. The first chamber is defined by upper portion 36 at the top, stabilizing wall 56 or inner wall 58 on one side, and an inner wall 62 on the opposite side. A second chamber 64 is located below band 30 and is defined by cuff portion 16 on one side, hand portion 12 and particularly opposing back side portion 20 on the opposite side, and top layer 44 defines at least a portion of the second chamber bottom.

Having described the structure of the preferred embodiment, a preferred method of operation will now be described in detail and should be read in light of FIGS. 1 through 4 and particularly FIGS. 3 and 4.

FIGS. 3 and 4 illustrate a first preferred embodiment method of operation. Initially, a cooling air flow, indicated by arrows 66, flows from the ambient air into first chamber 60. Next, the cooling air flow passes from first chamber 60 into second chamber 64 as indicated by arrows 68. The cooling air flow then passes from second chamber 64 into hand chamber 35 through second ventilation opening 42 as indicated by arrows 70. Once the cooling air flow is within hand chamber 35, the air can travel out opening 31 or continue to travel towards end 52 as indicated by arrows 72 and ultimately exiting hand chamber 35 proximate palm portion 18.

In an alternative embodiment (not shown), the method of operation may be reversed so that warm air exits the vent instead of cool air entering the vent. Specifically, warm air originally within hand chamber 35 passes into second chamber 64, through first chamber 60, and ultimately exits air flow gap 41 to the ambient air.

Although the preferred embodiment glove has been illustrated and described with air flow gap 41 on only one side, it should be immediately apparent to one of ordinary skill in the art that any number of air flow gaps may be located between cover 34 and band 30. Further, while the preferred embedment incorporates a horizontal orientation for air flow gap 41, a vertical orientation may be substituted without departing from the spirit and scope of the present invention as claimed.

Thus, band 30 provides a ventilation system for an athletic glove which reduces the ability for moisture to enter the glove and protects the player from impact. The ventilation system includes first and second ventilation openings in communication with one another that direct air flow into or out of the hand compartment, thereby increasing player comfort.

It will be evident to one skilled in the art that a variety of changes can be made that are within the spirit and scope of the present invention. For instance, the ventilation system may be incorporated directly into the cuff portion if a band is not desired.

Accordingly, the athletic glove is an effective, safe, inexpensive, and efficient device that achieves all the enumerated objectives of the invention, provides for eliminating difficulties encountered with prior art devices, systems, and methods, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the athletic glove is constructed and used, the characteristics of the construction, and the advantageous new and useful results obtained; the new and useful structures, devices, elements, arrangement, parts, and combinations are set forth in the appended claims.

What is claimed is:

1. A glove comprising:

a hand portion having a palm portion and an opposing back side portion, the back side portion including a plurality of protective portions formed therein, the palm portion and opposing back side portion defining a cavity;

a cuff portion; and a band disposed on and outward of the cuff portion and having a first ventilation opening, wherein the cuff portion has a second ventilation opening disposed coaxially with the first ventilation opening, and wherein air traverses through the first and second ventilation openings to the cavity.

2. The glove of claim 1, wherein the band further comprises a cover defining an air flow gap between the cover and the first ventilation opening.

3. The glove of claim 2, wherein the cover is fixedly secured to the cuff.

4. The glove of claim 2, further comprising an intermediate opening disposed between the first and second ventilation openings.

5. The glove of claim 1, further comprising a first chamber located intermediate the air flow gap and the first ventilation opening.

6. The glove of claim 5, further comprising a second chamber located intermediate the first ventilation opening and the second ventilation opening.

7. The glove of claim 6, wherein the first chamber is larger than the second chamber.

8. The glove of claim 6, wherein the second chamber is larger than the first chamber.

9. The glove of claim 2, wherein the air flow gap is directed towards the cuff portion.

10. The glove of claim 1, wherein the first and second ventilation openings are generally triangular in shape.

11. The glove of claim 9, wherein the air flow gap is oriented generally parallel to the opposing back side portion.

12. The glove of claim 9, wherein the air flow gap is disposed at an angle relative to the opposing back side portion.

13. The glove of claim 6, wherein the cuff further comprises a top layer and the second chamber extends above the top layer.

14. The glove of claim 12, wherein the opposing back side portion defines at least a portion of the second chamber.

15. The glove of claim 1, wherein the first ventilation opening is larger than the second ventilation opening.

16. A method of ventilating a glove, the method comprising:

directing ambient air through a first ventilation opening in a band disposed on and outward of a cuff portion of a glove;

directing the ambient air through a second, ventilation opening in the cuff portion, wherein the second ventilation opening is disposed coaxially with the first ventilation opening; and directing the ambient air across a player hand and through a cuff opening of the glove.

17. The method of claim 16, wherein directing the ambient air across a player hand includes directing the air flow towards a finger portion before directing the ambient air through the cuff opening.

18. The method of claim 16, further comprising directing the ambient air into a ventilation chamber disposed between the first ventilation opening and the second ventilation opening.

19. The method of claim 18, further comprising directing the ambient air from the ventilation chamber into a hand chamber.

20. The method of claim 17, wherein-directing the ambient air across a player hand comprises directing the airflow towards the finger portion and a player wrist simultaneously.

21. The glove of claim 1, wherein an axis of the first ventilation opening is not parallel to an axis of the second ventilation opening.

22. A glove, comprising:

a cuff portion; and a band disposed about the cuff portion, wherein the band defines a first ventilation opening, wherein the cuff portion defines a second ventilation opening, and wherein the first ventilation opening is in communication with the second ventilation opening, wherein an axis of the first ventilation opening extends through the second ventilation opening, and wherein an axis of the second ventilation opening extends through the first ventilation opening.

23. The glove of claim 22, wherein the first ventilation opening overlaps the second ventilation opening.

24. The glove of claim 22, wherein the first ventilation opening and the second ventilation opening define a chamber therebetween.

25. The glove of claim 22, comprising:

a cover coupled to the band, wherein the cover extends over at least a portion of the first ventilation opening.

26. The glove of claim 25, wherein the cover comprises a stabilizing wall extending within the first ventilation opening.

27. The glove of claim 26, wherein the cover comprises a mounting flange coupled to the stabilizing wall, wherein the mounting flange is disposed without the first ventilation opening, and is coupled to the band.

28. The glove of claim 25, wherein the cover and the first ventilation opening define an air flow gap therebetween.

29. The glove of claim 22, wherein the band is disposed over the second ventilation opening.

* * * * *